US011011296B2

(12) United States Patent
Muneuchi

(10) Patent No.: US 11,011,296 B2
(45) Date of Patent: May 18, 2021

(54) METHOD FOR MANUFACTURING A SURFACE MOUNTED INDUCTOR

(71) Applicant: Murata Manufacturing Co., Ltd., Kyoto (JP)

(72) Inventor: Keita Muneuchi, Tsurugashima (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 1001 days.

(21) Appl. No.: 15/446,563

(22) Filed: Mar. 1, 2017

(65) Prior Publication Data

US 2017/0178793 A1 Jun. 22, 2017

Related U.S. Application Data

(63) Continuation of application No. PCT/JP2015/075102, filed on Sep. 3, 2015.

(30) Foreign Application Priority Data

Sep. 5, 2014 (JP) ..... JP2014-180928

(51) Int. Cl.
*H01F 7/06* (2006.01)
*H01F 27/28* (2006.01)
(Continued)

(52) U.S. Cl.
CPC ..... *H01F 27/2823* (2013.01); *H01F 17/04* (2013.01); *H01F 27/255* (2013.01);
(Continued)

(58) Field of Classification Search
CPC ..... H01F 17/04; H01F 41/076; H01F 41/10; H01F 27/255; H01F 27/2823; H01F 27/292; H01F 2017/048
See application file for complete search history.

(56) References Cited

U.S. PATENT DOCUMENTS 6,373,368 B1 * 4/2002 Shikama ..... H01F 41/04 29/605
6,725,525 B1 4/2004 Shikama et al.
(Continued)

FOREIGN PATENT DOCUMENTS

JP 2001-052937 A 2/2001
JP 2008-263013 A 10/2008
(Continued)

OTHER PUBLICATIONS

International Search Report issued in PCT/JP2015/075102; dated Nov. 17, 2015.
(Continued)

*Primary Examiner* — Paul D Kim
(74) *Attorney, Agent, or Firm* — Studebaker & Brackett PC

(57) ABSTRACT

A surface mounted inductor is equipped with a coil formed by winding a conductive wire, and a formed body in which the coil is sealed with a sealing material that mainly contains metal magnetic powder and a resin. The coil is embedded so that surfaces of lead-out ends are exposed on surfaces of the formed body. The resin at portions of surfaces of the formed body where external terminals are formed is removed, and the metal magnetic powder and a plating layer forming the external terminals are joined to each other, thereby connecting the external terminals and the lead-out ends of the coil.

3 Claims, 4 Drawing Sheets

(51) Int. Cl.

| | |
|---|---|
| ***H01F 41/10*** | (2006.01) |
| ***H01F 17/04*** | (2006.01) |
| ***H01F 41/076*** | (2016.01) |
| ***H01F 27/255*** | (2006.01) |
| ***H01F 27/29*** | (2006.01) |

(52) U.S. Cl.
CPC ..... *H01F 27/292* (2013.01); *H01F 41/076* (2016.01); *H01F 41/10* (2013.01); *H01F 2017/048* (2013.01)

(56) References Cited

U.S. PATENT DOCUMENTS

| | | | | |
|---|---|---|---|---|
| 6,876,286 | B2 | 4/2005 | Shikama et al. | |
| 8,520,362 | B2 * | 8/2013 | Ogawa ..... | H01G 4/30 361/306.3 |
| 2003/0206089 | A1 | 11/2003 | Shikama et al. | |
| 2013/0255071 | A1 | 10/2013 | Muneuchi et al. | |
| 2016/0035476 | A1 | 2/2016 | Mimura et al. | |

FOREIGN PATENT DOCUMENTS

| | | | |
|---|---|---|---|
| JP | 2009-170488 | A | 7/2009 |
| JP | 2010-177492 | A | 8/2010 |
| JP | 2010-186909 | A | 8/2010 |
| JP | 2010-245473 | A | 10/2010 |
| JP | 2011-003761 | A | 1/2011 |
| JP | 2013-149814 | A | 8/2013 |
| JP | 2013-211333 | A | 10/2013 |
| JP | 2016-032050 | A | 3/2016 |
| KR | 10-2001-0067075 | A | 7/2001 |
| KR | 10-2013-0111452 | A | 10/2013 |
| TW | 466513 | B | 12/2001 |

OTHER PUBLICATIONS

Written Opinion issued in PCT/JP2015/075102; dated Nov. 17, 2015.

International Preliminary Report on Patentability issued in PCT/JP2015/075102; dated Mar. 7, 2017.

An Office Action mailed by the Japanese Patent Office dated Aug. 7, 2018, which corresponds to Japanese Patent Application No. 2017-140731 and is related to U.S. Appl. No. 15/446,563.

An Office Action; "Notification of Preliminary Rejection," issued by the Korean Intellectual Property Office dated Mar. 20, 2018, which corresponds to Korean Patent Application No. 10-2017-7006068 and is related to U.S. Appl. No. 15/446,563.

An Office Action; "Notice of Reasons for Rejection" issued by the Japanese Patent Office dated Feb. 28, 2017, which corresponds to Japanese Patent Application No. 2014-180928 and is related to U.S. Appl. No. 15/446,563, with English language translation.

Notification of the First Office Action issued by the State Intellectual Property Office of the People's Republic of China dated Oct. 26, 2017, which corresponds to Chinese Patent Application No. 201580047160.4 and is related to U.S. Appl. No. 15/446,563.

* cited by examiner

FIG.4( A )
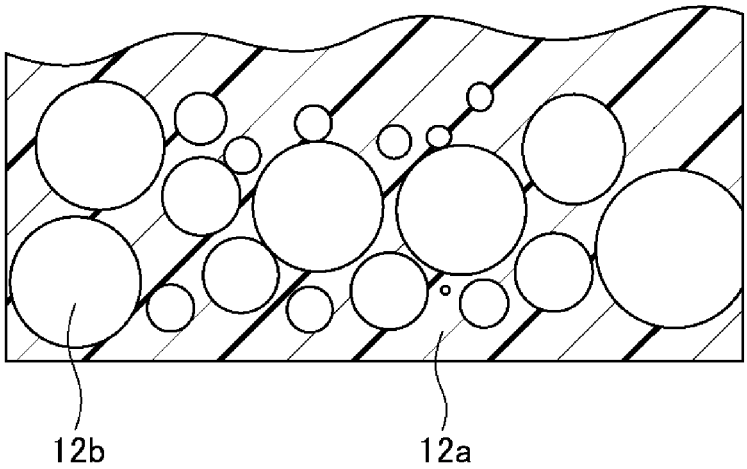
FIG.4( B )
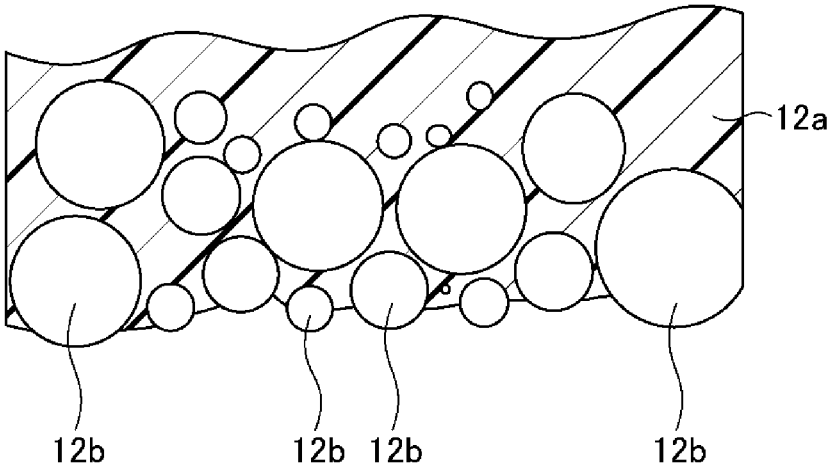
FIG.4( C )
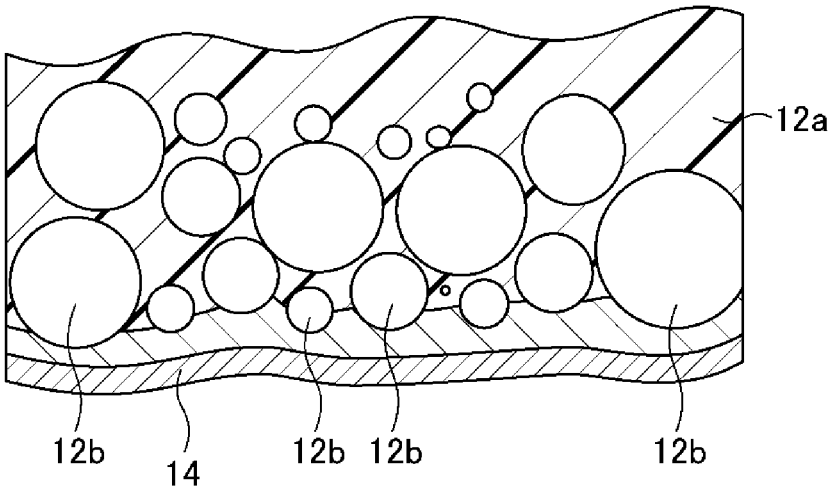

METHOD FOR MANUFACTURING A SURFACE MOUNTED INDUCTOR

CROSS REFERENCE TO RELATED APPLICATIONS

This application claims benefit of priority to Japanese Patent Application 2014-180928 filed Sep. 5, 2014, and to International Patent Application No. PCT/JP2015/075102 filed Sep. 3, 2015, the entire content of which is incorporated herein by reference.

TECHNICAL FIELD

The present disclosure relates to a surface mounted inductor equipped with a coil formed by winding a conductive wire, and a formed body in which the coil is sealed with a sealing material that mainly contains metal magnetic powder and a resin, and a method for manufacturing the same.

BACKGROUND ART

As a conventional surface mounted inductor, as shown in FIG. 5, there is a surface mounted inductor in which a conductive wire is wound to form a coil 21, the coil 21 is embedded in a formed body 22 formed with a sealing material that contains magnetic powder and a resin, and the coil 21 is connected to external terminals 24 formed on surfaces of the formed body 22 (for example, refer to JP 2010-245473 A). In this surface mounted inductor, the coil 21 formed by winding the conductive wire is placed on a tablet, the coil and the tablet are arranged in a molding die so that a lead-out end 21*b* of the coil 21, which is placed along an outer side surface of a pillar-shaped convex portions of the tablet, is interposed between the outer side surface of the pillar-shaped convex portions of the tablet and an inner wall surface of a molding die. Using this molding die, a formed body 22 incorporating the coil 21 is formed by a compression molding method or a powder compacting method. A conductive paste is applied to the formed body by dipping to form external terminals 24.

Recently, accompanying further miniaturization of electronic equipment, in the surface mounted inductor with such a structure, there is a possibility that an external electrode formed on an upper surface is brought into contact with a shielding plate and thereby short-circuited. Therefore, there has been an increased demand for a surface mounted inductor in which the electrode is formed to have an L-shaped structure.

Under such circumstances, in the conventional surface mounted inductor, when attempting to form an external terminal with an L-shaped structure, since the conductive paste is applied to the formed body by dipping, it was difficult to form the external terminal in an L-shape. Furthermore, in the conventional surface mounted inductor, since the formed body is dipped in the conductive paste stored in a conductive paste tank, the conductive paste in an amount enough to immerse portions forming external terminals of the formed body is required, and besides that, if the amount to be disposed of for the sake of quality control is included, a large amount of the conductive paste goes to waste resulting also in a cause of an increase in production cost.

In order to solve such problems, as shown in JP 2009-170488 A, an external terminal was formed with a plate-shaped metal frame, the overall shape is increased by a thickness of the metal frame, while the sizes of the coil and the formed body are reduced, so that the adequate characteristics cannot be obtained, and an increased number of man-hours is required to form the external terminal.

As an alternative solution, forming the external terminals by sputtering is considered, but expensive equipment is required.

SUMMARY

An object of one or more embodiments of the present disclosure is providing a surface mounted inductor, an external terminal of which is formed easily without using expensive equipment, and a method for manufacturing the same and thereby achieving a low-profile as well as an improvement in the characteristics.

In one or more embodiments of the present disclosure, a surface mounted inductor comprises:

- a coil formed by winding a conductive wire; and
- a formed body including a sealing material, the sealing material sealing the coil and mainly containing metal magnetic powder and a resin, wherein
- the coil is embedded in the formed body so that surfaces of lead-out ends are exposed on surfaces of the formed body;
- the resin provided at portions in the surfaces of the formed body is removed, the portions being where the external terminals are formed;
- the metal magnetic powder and a plating layer forming the external terminals are joined to each other; and
- the external terminals and the lead-out ends of the coil are connected to each other.

Also, in one or more embodiments of the present disclosure, a surface mounted inductor comprises:

- a coil formed by winding a conductive wire; and
- a formed body including a sealing material, the sealing material sealing the coil and mainly containing metal magnetic powder and a resin, wherein
- the coil is embedded in the formed body, and lead-out ends of the coil are led out from the formed body;
- the resin provided at portions in the surfaces of the formed body is removed, the portions being where the external terminals are formed;
- the metal magnetic powder and a plating layer forming the external terminals are joined to each other; and
- the external terminals and the lead-out ends of the coil are connected to each other.

Furthermore, in one or more embodiments of the present disclosure, a method for manufacturing a surface mounted inductor comprising a coil formed by winding a conductive wire, and a formed body including a sealing material, the sealing material sealing the coil and mainly containing metal magnetic powder and a resin, comprises the steps of:

- embedding the coil formed by winding the conductive wire in the formed body;
- removing the resin provided at portions in the surfaces of the formed body, the portion being where external terminals are formed;
- plating the formed body, thereby forming a plating layer joined to the metal magnetic powder at the portions where the resin has been removed; and
- forming the external terminals connected to the lead-out ends of the coil.

In one or more embodiments of the present disclosure, a surface mounted inductor comprises:

- a coil formed by winding a conductive wire; and a formed body including a sealing material, the sealing material sealing the coil and mainly containing metal magnetic powder and a resin, wherein the coil is embedded in the formed body so that surfaces of lead-out ends are exposed on surfaces of the formed body;

the resin provided at portions in the surfaces of the formed body is removed, the portions being where the external terminals are formed;

the metal magnetic powder and a plating layer forming the external terminals are joined to each other; and the external terminals and the lead-out ends of the coil are connected to each other. Therefore, it is possible to easily form an external terminal without using expensive equipment, and possible to achieve a low-profile as well as an improvement in the characteristics.

In one or more embodiments of the present disclosure, a surface mounted inductor comprises:

a coil formed by winding a conductive wire; and a formed body including a sealing material, the sealing material sealing the coil and mainly containing metal magnetic powder and a resin, wherein the coil is embedded in the formed body, and lead-out ends of the coil are led out from the formed body, and the lead-out ends of the coil are connected with external terminals. Therefore, it is possible to easily form an external terminal without using expensive equipment, and possible to achieve a low-profile as well as an improvement in the characteristics.

Furthermore, in one or more embodiments of the present disclosure, a method for manufacturing a surface mounted inductor comprising a coil formed by winding a conductive wire, and a formed body including a sealing material, the sealing material sealing the coil and mainly containing metal magnetic powder and a resin, comprises the steps of:

embedding the coil formed by winding the conductive wire in the formed body; and removing the resin provided at portions in the surfaces of the formed body, the portion being where external terminals are formed, plating the formed body thereby forming a plating layer joined to the metal magnetic powder at the portions where the resin has been removed, and forming the external terminals connected to the lead-out ends of the coil. Therefore, it is possible to easily form an external terminal without using expensive equipment, and possible to achieve a low-profile as well as an improvement in the characteristics.

BRIEF DESCRIPTION OF THE DRAWINGS

FIGS. 4(A), 4(B) and 4(C) are schematic views for explaining an external terminal in the embodiment of the surface mounted inductor of the present disclosure.

DETAILED DESCRIPTION

According to one or more embodiments of the surface mounted inductor of the present disclosure, since the resin at the portions of the surfaces of the formed body where the external terminals are formed is removed, the metal magnetic powder forming the formed body is exposed, and plating is easily grown at the portions compared to their surroundings. At this time, by adjusting the shape of the portions of the surfaces of the formed body where the resin is removed, it is easily possible to change the shape of the external terminals. It is also possible to reduce the thickness of the external terminals to as thin as 20 μm or less, so that the size of the formed body can be increased by the reduction in the thickness, or the overall shape can be reduced. When the size of the formed body is increased by the reduction in the thickness of the external terminals, the thickness of the conductive wire can be increased or the size of the coil can be increased.

Furthermore, according to one or more embodiments of the method for manufacturing the surface mounted inductor of the present disclosure, since the resin at the portions of the surfaces of the formed body where the external terminals are formed is removed, the metal magnetic powder forming the formed body is exposed, and plating is easily grown at the portions compared to their surroundings. At this time, by adjusting the shape of the portions of the surfaces of the formed body where the resin is removed, it is easily possible to change the shape of the external terminals. It is also possible to reduce the thickness of the external terminals to as thin as 20 μm or less, so that the size of the formed body can be increased by the reduction in the thickness, or the overall shape can be reduced. When the size of the formed body is increased by the reduction in the thickness of the external terminals, the thickness of the conductive wire can be increased or the size of the coil can be increased.

The best mode for carrying out the present disclosure will hereinafter be described with reference to FIG. 1 through FIG. 4.

Figure 1:
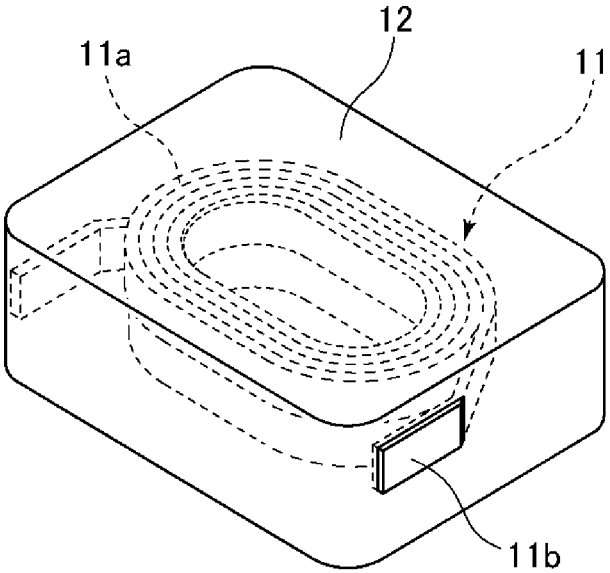
FIG. 1 is a perspective view of a formed body in an embodiment of a surface mounted inductor of the present disclosure.

FIG. 1 is a perspective view of a formed body in an embodiment of a surface mounted inductor of the present disclosure.

In FIG. 1, reference numeral 11 denotes a coil, and reference numeral 12 denotes a formed body.

In the coil 11, by winding a conductive wire in two tiers in an outside-to-outside manner so that both of its ends are positioned at an outer periphery thereof, a coreless coil including a wound portion 11*a* and lead out ends 11*b* led out from the wound portion 11*a* is obtained. A rectangular wire that is rectangular in cross section is used as the conductive wire. The lead-out ends 11*b* are led out so as to be opposite to each other across the wound portion.

A formed body 12 is formed with a sealing material containing a resin and a magnetic material so as to incorporate the coil 11. The sealing materials used include those obtained by using the magnetic material such as iron-based metal magnetic powder and the resin such as an epoxy resin and mixing them. On side surfaces opposed in the length direction of the formed body 12, surfaces of the lead-out ends 11*b* of the coil 11 are exposed.

On the side surfaces opposed in the length direction of the formed body 12 and on a bottom surface thereof, external terminals 14 are formed thereby connecting the lead-out ends 11*b* of the coil 11 and the external terminals 14. Each external terminal 14 is formed in an L-shape by a plating layer using a metal material such as Ni or Sn.

Such a surface mounted inductor is manufactured in the following manner. First, a conductive wire which is rectangular in cross section and provided with an insulation coating is spirally wound in two tiers in an outside-to-outside manner so that both of its ends are positioned at an outer periphery thereof thus forming a wound portion 11*a*. Thereafter, both the ends of the conductive wire are led out from the outer periphery of the wound portion thereby forming lead-out ends 11*b*, thus forming a coreless coil 11. The conductive wires used in the present embodiment include those having an imide-modified polyurethane layer as an insulating film. The insulating film may be a polyamide- or polyester-based insulating film, and those with a high heat-resistant temperature are preferred. In the present embodiment, although those which are rectangular in cross section are used, circular conductive wires or those which are polygonal in cross section may also be used.

Next, by using a sealing material obtained by using the magnetic material such as iron-based metal magnetic powder and the resin such as an epoxy resin and mixing and granulating them into powder, a formed body 12 in which the coreless coil 11 shown in FIG. 1 is embedded is formed by a compression molding method. At this time, the lead-out ends 11*b* of the coreless coil 11 are configured so that their surfaces are exposed at positions on side surfaces opposed in the length direction of the formed body 12, where external terminals are formed. Although the formed body is made by the compression molding method in the present embodiment, it may also be formed by a molding method such as a powder compacting method.

Figure 2:
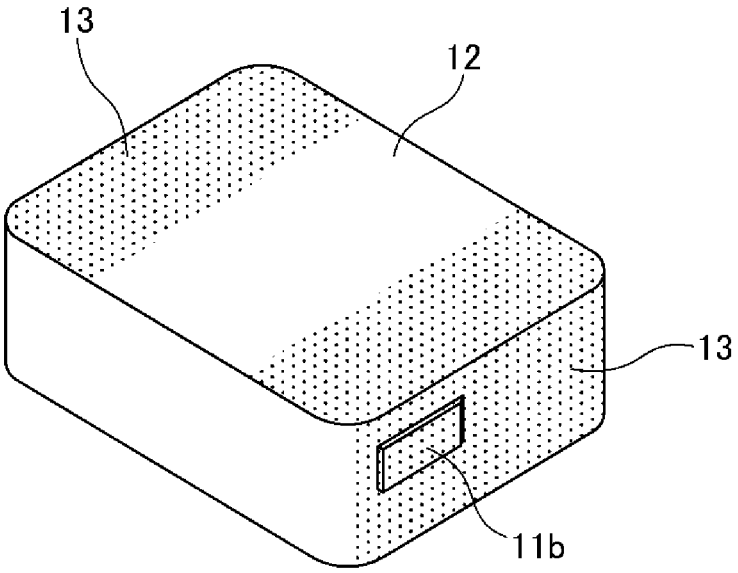
FIG. 2 is a perspective view of a processed formed body in the embodiment of the surface mounted inductor of the present disclosure.

Subsequently, after removing the film on the surfaces of the lead-out ends 11*b* of the coreless coil 11 by mechanical peeling, as shown in FIG. 2, resin components and the like existing at portions 13 on the side surfaces opposed in the length direction of the formed body 12 and on a bottom surface thereof, where the external terminals are formed, are removed by using laser irradiation, blasting treatment, polishing and the like. Thereby, surfaces of the metal magnetic powder forming the formed body 12 and cut surfaces thereof are exposed.

Figure 3:
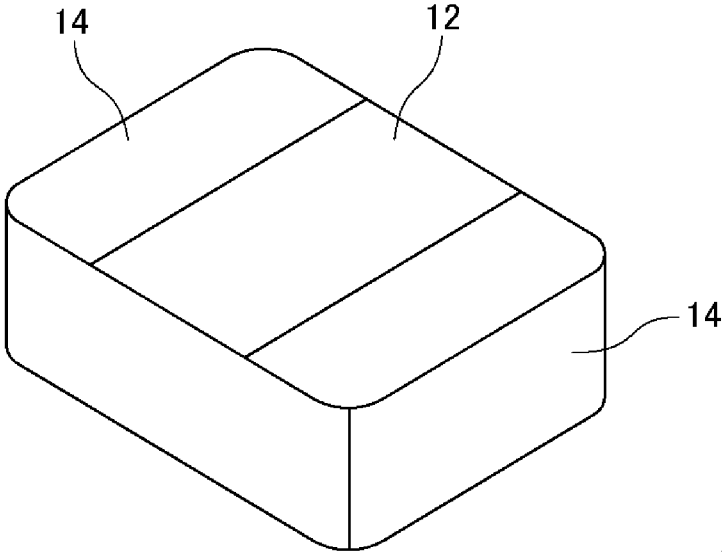
FIG. 3 is a perspective view showing the embodiment of the surface mounted inductor of the present disclosure.
Figure 5:
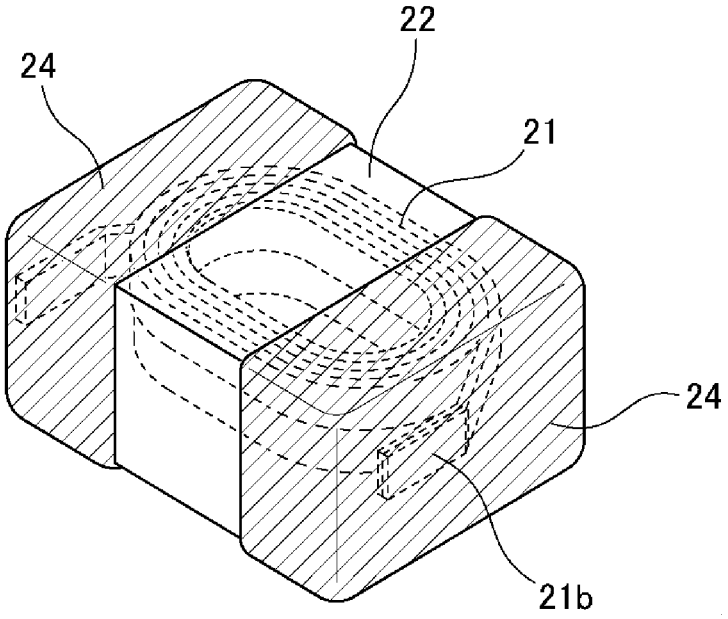
FIG.5 PRIOR ART
FIG. 5 is a perspective view of a conventional surface mounted inductor.

Furthermore, the formed body 12 is plated with a conductive material, thereby forming a plating layer joined to the metal magnetic powder on the side surfaces opposed in the length direction of the formed body 12 and on the bottom surface thereof, so that the external terminals 14 are formed as shown in FIG. 3. Examples of the conductive materials used include those containing Ni or Sn, or those containing both. The external terminals 14 are connected to the lead-out ends 11*b* of the coreless coil 11, which are exposed on the surfaces of the formed body 12.

In the thus formed surface mounted inductor of the present disclosure, since the formed body is formed with the sealing material containing the resin and the metal magnetic powder, as shown in FIG. 4 (A), its surface is covered with a resin 12*a*, and metal magnetic powder 12*b* is mixed therein. Here, resin components and the like existing at a portion of the formed body where an external terminal is formed are removed by using laser irradiation, blasting treatment, polishing and the like. Thereby the metal magnetic powder 12*b* is exposed on the portion of the surface of the formed body where an external electrode is formed as shown in FIG. 4(B). The formed body is plated with the conductive material in this state, thereby forming a plating layer 14 on the portion of the formed body, where the external terminal is formed, as shown in FIG. 4 (C). This is attributed to the fact that, because the metal magnetic powder 12*b* has a metallic nature, by plating the formed body, an electric current is intensively applied to the portion of the surface of the formed body where the metal magnetic powder is exposed, thereby growing plating, with the result that the plating layer 14 is formed on the portion of the surface of the formed body where the metal magnetic powder is exposed. Although FIG. 4 (C) shows a case where this plating layer 14 is formed of double layers, it may also be formed of a single layer, or of triple layers or more.

Therefore, in the surface mounted inductor of the present disclosure, the plating layer joined to the metal magnetic powder is formed at the portions of the surfaces of the formed body where the resin has been removed, so that the external terminals connected to the lead-out ends of the coreless coil are formed on the formed body.

Although the above has described the embodiments of the surface mounted inductor and method for manufacturing the same of the present disclosure, the present disclosure is not limited to these embodiments. In examples, in the sealing material, the iron-based metal magnetic powder was used as the magnetic material, and the epoxy resin was used as the resin. As the magnetic material, metal magnetic powders having other compositions, metal magnetic powder whose surface is coated with an insulator such as glass, and surface-modified metal magnetic powder may also be used. As the resin, a thermoset resin such as a polyimide resin or a phenol resin, and a thermoplastic resin such as a polyethylene resin or a polyamide resin may also be used. Furthermore, the external terminals may also be formed by plating the formed body with a conductive material other than Ni or Sn, thereby forming a plating layer joined to the metal magnetic powder. Furthermore, the formed body may also be plated after applying a joint material composed of a conductive paste and the like containing a conductor such as Ag or Cu to the positions at which the lead-out ends of the coreless coil are exposed on the portions of the formed body, where the external terminals are formed, so as to cover the lead-out ends of the coreless coil. In this case, the bonding strength between the lead-out ends of the coil and the external terminals can be improved by this joint material.

Furthermore, although the embodiments have shown an example in which the coil is embedded in the formed body so that the surfaces of the lead-out ends of the coil are exposed on the surfaces of the formed body, they may also be configured so that the coil is embedded in the formed body so that the lead-out ends of the coil are led out from the formed body, that the film of the surfaces of the lead-out ends of the coil is removed, that the resin components and the like existing at the portions where the external terminals of the formed body are formed are removed, that the lead-out ends are processed so as to be positioned at the portions where the external terminals are formed, and that, in this state, the formed body is plated, thereby forming the external terminals. Moreover, in this case, the external terminals may also be formed in the following manner: The joint material composed of the conductive paste containing the conductor such as Ag or Cu or the like is applied so as to cover the lead-out ends of the coil, which are positioned at the portions where the external terminals are formed, and, in the state in which the lead-out ends of the coil are fixed to the formed body, the formed body is plated to form the external terminals.

The invention claimed is:

1. A method for manufacturing a surface mounted inductor including a coil formed by winding a conductive wire, and a formed body including a sealing material, the sealing material sealing the coil and containing metal magnetic powder and a resin, the method comprising the steps of:

embedding the coil formed by winding the conductive wire in the formed body including the metal magnetic powder including iron and the resin;

removing the resin provided at portions in the surfaces of the formed body to expose the metal magnetic powder including the iron in the surfaces of the formed body, the portion being where external terminals are formed;

electrolytic plating the formed body, thereby selectively growing a plating in surfaces of the metal magnetic powder including the iron exposed in the surfaces of the formed body, forming a plating layer directly contacting the metal magnetic powder including the iron at the portions where the resin has been removed; and forming the external terminals connected to lead-out ends of the coil, wherein the external terminals are formed on the formed body in which the coil is embedded.

2. The method for manufacturing a surface mounted inductor according to claim 1, wherein a conductive paste is applied to portions of the formed body where the lead-out ends of the coil are positioned.

3. The method for manufacturing a surface mounted inductor according to claim 1, wherein the lead-out ends of the coil are fixed to the surfaces of the formed body by a conductive paste.

* * * * *